United States Patent [19]

Martienssen

[11] 3,996,621

[45] Dec. 14, 1976

[54] BATHING CAP

[75] Inventor: Liselotte Martienssen, Hamburg, Germany

[73] Assignee: Hauni-Werke Korber & Co., KG, Hamburg, Germany

[22] Filed: Jan. 28, 1975

[21] Appl. No.: 544,778

[30] Foreign Application Priority Data

Feb. 15, 1974 Germany ..... 2407215

[52] U.S. Cl. ..... 2/68

[51] Int. Cl.[2] ..... A42B 1/12

[58] Field of Search ..... 2/68, 174, 171, 195

[56] References Cited

UNITED STATES PATENTS

| | | | |
|---|---|---|---|
| 734,578 | 7/1903 | Lemmermann | 2/68 |
| 1,352,383 | 9/1920 | Riley | 2/68 X |
| 1,363,408 | 12/1920 | Guinzburg | 2/68 |
| 1,971,288 | 8/1934 | Lampe | 2/68 |
| 2,285,659 | 6/1942 | Howland | 2/68 |
| 2,524,463 | 10/1950 | Moore | 2/68 |
| 3,019,444 | 2/1962 | Pollack et al. | 2/68 |
| 3,394,406 | 7/1968 | Bengems | 2/68 |

FOREIGN PATENTS OR APPLICATIONS

| | | | |
|---|---|---|---|
| 390,014 | 3/1933 | United Kingdom | 2/68 |

*Primary Examiner*—H. Hampton Hunter
*Attorney, Agent, or Firm*—Peter K. Kontler; John Kurucz

[57] ABSTRACT

A waterproof bathing cap wherein a pouch consisting of shape-retaining flexible synthetic plastic sheet material serves to loosely surround the hair of a wearer, an elastic band engages the skin close to and along the hairline on the wearer's head, and a preferably elastic flexible oval ring connects the band with the pouch in the region of an opening through which the hair passes into and out of the pouch when the cap is put onto or removed from the head. The ring flares outwardly toward the opening and is sealingly bonded to the band and pouch.

10 Claims, 3 Drawing Figures

BATHING CAP

BACKGROUND OF THE INVENTION

The present invention relates to bathing caps, and more particularly to bathing caps which can be worn with advantage by women of all ages to preserve the hair/do in and outside of water.

Bathing caps (this term is intended to embrace shower caps) are worn by men and women of all ages in order to protect the hair from contact with water. In fact, many public baths require that each female visitor wear a bathing cap while in a swimsuit. Presently known bathing caps cannot completely prevent the penetration of water; as a rule, some water will penetrate into the cap in the region of the nape whenever the corresponding portion of the cap is immersed into water, either in a bathtub or during swimming (especially while the wearer swims on his or her back). Penetration of some water into the cap, especially along the nape, cannot be prevented even if the entire bathing cap consists of an elastomeric material and is dimensioned in such a way that it closely adheres to the skull of the user, i.e., that it must be forcibly pulled onto the head. Moreover, such tightly fitting caps destroy the hairdo by pressing the hair against the skull. Thus, any waves, locks and other features of a home-made or beautician-made hairdo will be deformed as soon as the cap is applied.

SUMMARY OF THE INVENTION

An object of the invention is to provide a novel and improved bathing cap which can be applied and worn without affecting the hairdo and which positively prevents any contact between water and hair even if the user's head is completely submerged in water.

Another object of the invention is to provide a bathing cap which, though perphaps more likely to be used by women, can be worn as a waterproof protector against penetration of any moisture as well as against damage to the hairdo of male and/or female users of all age groups.

A further object of the invention is to provide an eye-pleasing and relatively simple and inexpensive but waterproof bathing cap which can be assembled of readily available materials and can stand long periods of use, which can prevent penetration of water into contact with confined hair even though it does not or need not employ detachable strips, snap fasteners for such strips and/or other separable or rigid parts, and which can prevent penetration of any water not only in the region of the neck, temples and cheeks but also along the nape of the wearer even if the wear's head is submerged in water to an extent and in a position which invariably results in penetration of water into a conventional cap.

The invention is embodied in a waterproof bathing cap which comprises an endless elastic band sealingly engaging the skin around the hair-covered area on the head of the user, a hair-confining receptacle (hereinafter called pouch) having an opening adjacent to the band, and an oval ring or an analogous endless intermediate portion which extends between the band and the opening of the pouch.

The intermediate portion may but need not consist of an elastomeric material and preferably diverges outwardly from that edge which is bonded or otherwise sealingly secured to the band toward that edge which surrounds the opening and is bonded or otherwise sealingly secured to the pouch. The band is preferably configurated with a view to closely follow the outline of an average hairline.

The pouch may consist of polyvinyl chloride foil or other suitable synthetic plastic sheet material which is preferably flexible within limits, i.e., its rigidity suffices to insure that the pouch can retain its shape when not intentionally deformed by hand, in storage or in response to contact with confined hair.

DESCRIPTION OF THE PREFERRED EMBODIMENTS

Figure 1:
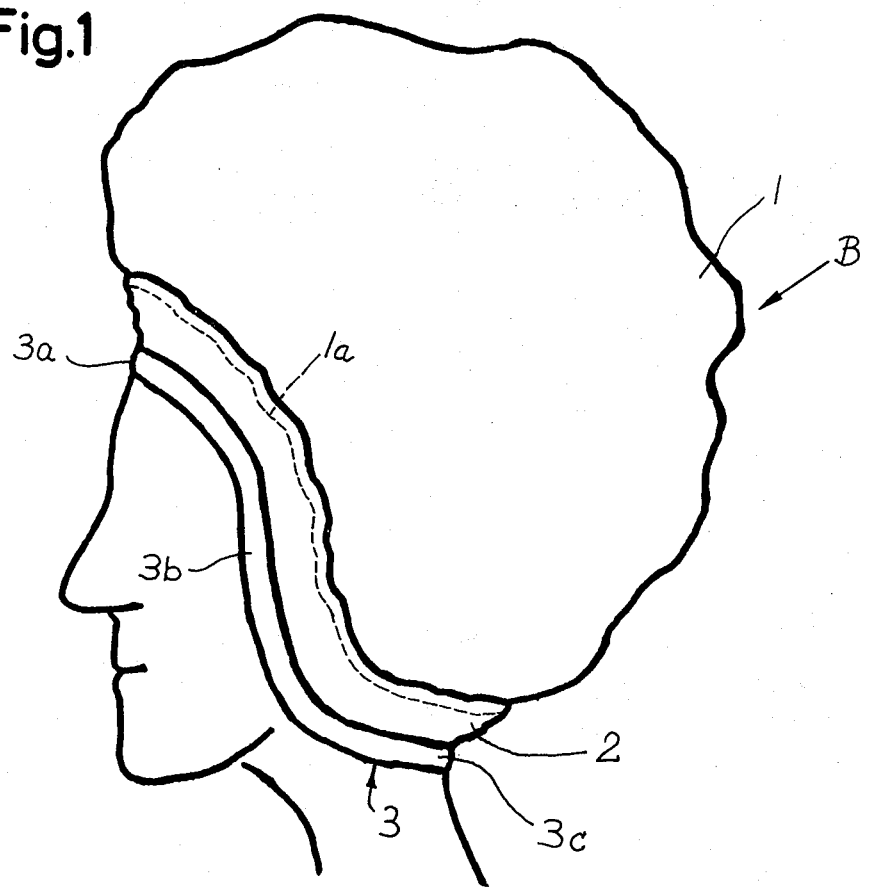
FIG. 1 is a schemaic side elevational view of the improved bathing cap which is shown as being applied to the head of a female wearer.
Figure 3:
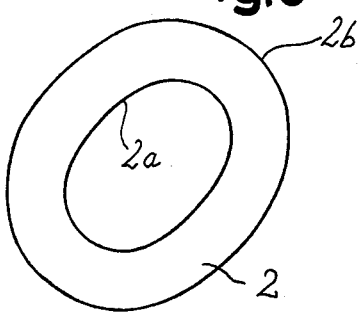
FIG. 3 is a smaller-scale plan view of the intermediate portion.

The bathing cap B of FIG. 1 comprises a pouch 1 which consists of flexible but preferably non-elastic material or a material exhibiting a small degree of elasticity (e.g., polyvinyl chloride), an oval ring-shaped intermediate portion 2 (see also FIG. 3), and an endless band 3 consisting of rubber or other suitable elastomeric material. The ring 2 may but need not consist of rubber or other elastomeric material. The inner and outer marginal portions 2*a* and 2*b* of the ring 2 are respectively bonded to the band 3 and to that portion of the pouch 1 which surrounds a relatively large opening 1*a* (indicated in FIG. 1 by a broken line). The bonding medium may be an adhesive, e.g., an adhesive known as "Bostik No. 1"produced by the West German firm BOSTIK. This adhesive is not adversely influenced by the softening agent in the material of the pouch 1.

Figure 2:
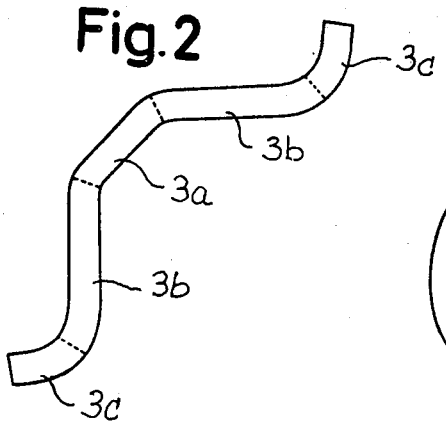
FIG. 2 is a smaller-scale developed view of a presently preferred embodiment of the band.

The preferred configuration of the band 3 (in a developed view) is shown in FIG. 2. The band section 3*a* engages the skin of the forehand just below and along the hairline, the sections 3*b* engage the skin along the temples and the respective cheeks (in front of the ears, see FIG. 1), and the section 3*c* engages the skin on the nape just below and along the hairline. Such configuration has been found to insure that the band 3 prevents penetration of water into the cap (i.e., into the space surrounded by the ring 2 and pouch 1) even if the user immerses his or her head into water, e.g., while sitting in a bathtub, on diving into a pool or during swimming while the section 3*c* and portions of the sections 3*b* are below the water surface. Of course, the elastic band 3 should be sufficiently small to require at least some expansion during placing of the cap onto the wear's head to assume the shape and position shown in FIG. 1.

When the band 3 is severed across any one of its sections 3*a*–3*c*, the sections can be placed into a common plane (see FIG. 2). If the band 3 is severed transversely midway across the section 3*c* (as shown in FIG. 2) the section 3*a* is located between the sections 3*b*, the sections 3b extend outwardly from the respective ends of the section 3*a* and are mirror symmetrical to each other (they make an angle greatly exceeding zero but less than 180°, and the halves of the section3*c* extend outwardly from the respective ends of the corresponding sections 3*b*.

The function of the ring 2 is to constitute an intermediate portion of the cap between the band 3 and the pouch portion surrounding the opening 1*a*, i.e., an intermediate portion which insures that the pouch need not closely adhere to the skull and/or hair in the region of the hairline. Thus, the ring 2 renders it possible to use a specially configurated band 3 (which sealingly engages the skin adjacent to and along the entire hairline) and a specially configurated pouch 1 which need not and normally should not closely follow the outline of the skull. The band 3 can sealingly engage the skin along the entire internal surface thereof, i.e., also along that portion of the hairline which extends across the nape and regardless of whether the wearer has long or short hair. The planes of the sections 3*a*, 3*c* are inclinded with respect to each other. The entire hairdo, inclusive of a large or small bun or one or more braids, is confined mainly within the pouch 1 and partly in the ring 2. The material of the pouch 1 is sufficiently flexible to be readily deformable by the coiffure while the latter passes through the opening 1*a* as well as while the cap is being worn. The entire cap B (including its components 1, 2 and 3) is waterproof, i.e., the components 1 – 3 are impermeable to fluids.

The cap B may be supplied in many sizes and shapes, and each of its components may be provided with a decorative design and/or colored in a manner to enhance its appearance and sales appeal. The configuration of the band 3 is preferably such that it follows, either closely or in part, the outline of the average hairline on a human head. As mentioned above, the cap preferably conceals the ears and the ring 2 is preferably oval so that it resembles the outline of an average face.

The improved cap is susceptible of many additional modification. For example, the pouch 1 may be made of rubber or other elastomeric material. However, a shape-retaining, flexible non-elastic material is preferred at this time because such pouch is less likely to be deformed by gravity to thereby press against and possibly deform the corresponding part of the hairdo. Pouches made of polyvinyl chloride are cheap, readily bondable to the rings and exhibit sufficient stability to avoid unintentional flattening or other deformation of the hairdo which is confined in the cap.

I claim:

1. A waterproof bathing cap, comprising an endless elastic band which is expansible to sealingly engage the skin around the hair-covered area of the head of a wearer, said band including a first elongated planar section the planar surface of which is located in a first plane and engages the forehead of the wearer below the hairline when the cap is in use, a second elongated planar section, the planar surface of said second section being located in a second plane inclined with respect to said first plane and engages the nape of the wearer below the hairline when the cap is in use, and two additional elongated sections which engage the temples and the cheeks of the wearer in front of the ears when the cap is in use, each of said additional sections being integral with one of said first section and with one end of said second section, all of said sections can be placed into a common plane when said band is severed transversely across any one of said sections and, when said band is severed transversely across and substantially midway between the ends of said second section, said first section is located between said additional sections, said additional sections are substantially mirror images symmetrical to each other and extend outwardly from the respective ends of said first section and make an angle greatly exceeding zero but less than 180°, and the halves of said second section extend outwardly from the respective ends of the corresponding additional sections (additional sections being inclined with respect to said first and second sections); a large deformable pouch loosely confining the hair of a wearer, said pouch being spaced apart from said band when the cap is applied to the head of a wearer and having an opening facing said band; a deformable endless intermediate portion extending between said band and the opening of said pouch; and means for sealingly securing said intermediate portion to said band and to said pouch in the region of said opening.

2. A cap as defined in claim 1, wherein said band consists of rubber.

3. A cap as defined in claim 1, wherein said intermediate portion is elastic.

4. A cap as defined in claim 3, wherein said intermediate portion consists of rubber.

5. A cap as defined in claim 1, wherein said intermediate portion is a substantially oval ring.

6. A cap as defined in claim 1. wherein said pouch consists of a non-elastic flexible material.

7. A cap as defined in claim 1, wherein the material of said pouch includes means for rendering said pouch sufficiently rigid to retain its shape against the action of gravity.

8. A cap as defined in claim 1, wherein said pouch consists of synthetic plastic material.

9. A cap as defined in claim 9, wherein said plastic material is polyvinyl chloride.

10. A cap as defined in claim 1, wherein said securing means is an adhesive.

* * * * *

UNITED STATES PATENT OFFICE

CERTIFICATE OF CORRECTION

Patent No. 3,996,621 Dated December 14, 1976

Inventor(s) Liselotte MARTIENSSEN

It is certified that error appears in the above-identified patent and that said Letters Patent are hereby corrected as shown below:

Foremost page, left-hand column, item [73] should be deleted (the patent is owned by the inventor).

Col. 1, line 8, "hair/do" should read --hairdo--;
line 53, "wear's" should read --wearer's--.
Col. 2, line 13, "schemaic" should read --schematic--;
line 43, "forehand" should read --forehead--;
line 66, "180°," should read --180°),--.
Col. 3, line 35, "modification." should read --modifications.--.

Claim 1, line 10, "engages" should read --engaging--;
line 15, --end-- should be inserted after "one";
line 28, "(additional sections being" should be deleted.
line 29, "inclined with respect to said first and second sections" should be deleted.

Signed and Sealed this

Nineteenth Day of April 1977

[SEAL]

*Attest:*

RUTH C. MASON
*Attesting Officer*

C. MARSHALL DANN
*Commissioner of Patents and Trademarks*